US006158618A

United States Patent [19]

Mercer

[11] Patent Number: 6,158,618

[45] Date of Patent: Dec. 12, 2000

[54] CONTROL CIRCUIT FOR MULTI-PRODUCT FUEL DISPENSER

[76] Inventor: Barton P. Mercer, 6114 Prospect St., Fredericksburg, Va. 22407

[21] Appl. No.: 09/213,562

[22] Filed: Dec. 17, 1998

[51] Int. Cl.[7] ..... B67D 5/00

[52] U.S. Cl. ..... 222/25; 222/52; 361/189; 361/191; 705/413

[58] Field of Search ..... 222/25–28, 52, 222/266; 361/189, 191; 700/231, 232, 282, 283; 705/413

[56] References Cited

U.S. PATENT DOCUMENTS

| | | | |
|---|---|---|---|
| 3,696,364 | 10/1972 | Lavelle . | |
| 3,824,435 | 7/1974 | Sebille et al. . | |
| 4,225,808 | 9/1980 | Saraceni . | |
| 4,292,542 | 9/1981 | Bajka . | |
| 4,390,870 | 6/1983 | Michael . | |
| 4,578,734 | 3/1986 | Delbosse . | |
| 4,719,532 | 1/1988 | Schneider | 361/189 |
| 5,027,282 | 6/1991 | Hollidge | 705/413 |
| 5,375,454 | 12/1994 | Andrejasich et al. | 73/40.5 R |
| 5,719,779 | 2/1998 | Shuler et al. | 700/231 |
| 5,874,787 | 2/1999 | Meyer et al. | 705/413 |

OTHER PUBLICATIONS

"Open the door to total service security"; R.S. Electronic Controls, Inc.; Entire Advertisement; Published prior to Dec. 17, 1998.

"EDC Electronic Device Controller"; R.S. Electronic Controls, Inc.; Mar., 1998.

Dispenser Manager—MPI; Brown Electrical Controls; W.A. Brown & Son, Inc.; Published prior to Dec. 17, 1998.

*Primary Examiner*—J. Casimer Jacyna
*Attorney, Agent, or Firm*—Adams, Schwartz & Evans, P.A.

[57] ABSTRACT

A control circuit array for controlling operation of a plurality of multi-product fuel dispensers ("MPDs") in response to control inputs from a control input source. The control circuit array includes an electric power source, switches for fuel grade selection and MPD lighting and outputs to submersible turbine fuel pumps for supplying fuel to the MPDs. The improvement comprises a modular circuit board for being connected in series to form the control circuit array, wherein each circuit board includes emergency shutoff means for responding to a single emergency shutoff input for shutting off all power to each of the plurality of MPDs and the turbine pumps supplying the MPDs. The control also includes maintenance shutoff means for shutting off all power to a single predetermined one of the plurality of MPDs in preparation for performing maintenance on the single MPD or turbine pump while permitting continued operation of the remaining MPDs and turbine pumps without feedback to the MPD under maintenance from the operating MPDs.

4 Claims, 2 Drawing Sheets

CONTROL CIRCUIT FOR MULTI-PRODUCT FUEL DISPENSER

TECHNICAL FIELD AND BACKGROUND OF THE INVENTION

This invention relates to a control circuit for a multi-product dispenser. A multi-product dispenser (referred to in this application as a "MPD,") is a fuel dispenser which includes in a single cabinet provisions for dispensing several grades or types of fuel. The cabinet, typically positioned on an island at a service station or convenience store, may have control circuitry and valving which permits one of several grades of fuel, for example, regular, mid-grade and premium grades of gasoline motor fuel, to be selectively dispensed through a single dispensing nozzle, or from a selected one of several nozzles connected to respective fuel supplies. The electrical circuits which control these dispensers are subject to regulations by several organizations. For example, National Electrical Code ("NEC") and National Fire Prevention Association ("NFPA") regulations require that "each circuit leading to or through dispensing equipment shall be provided with a switch or other acceptable means . . . to disconnect simultaneously from the source of supply all conductors of the circuit, including the grounded conductor, if any." NEC and NFPA 30A, Section 514-5. Sections (b) and (c) of NEC 514-5 and the notes to NFPA 30A further require emergency shutdown capability so that all electric power to the dispenser may be interrupted. NEC Section 514-6, new in 1999, further requires that "each dispensing device shall be provided with a means to remove all external voltage sources, including feedback, during periods of maintenance and service of the equipment."

The invention of this application is intended specifically to meet all of the current electrical and fire code requirements relevant to MPDs, and to do so by means of a single modular circuit board.

Conventional control circuits require that many of the circuit components be mounted and wires run between them in the field. Many such components must be mounted in their own electrical enclosures connected by conduits or raceways, or combined into a single enclosure unit by the field electrician. Thus, physical layout and groupings of components can differ from installer to installer based upon individual preferences. This variability can result in miswiring and consequent damage to equipment, overheating, construction delays and excessive repair costs. Even when all of the wiring is done correctly during installation, the variability in wiring may result in incorrect repairs or maintenance, particularly when carried out by different personnel than those who carried out the initial installation.

U.S. Pat. No. 4,719,532 ("'532 Patent") describes an electrical controller for actuating a number of electrical devices according to control inputs received from a number of control input sources, specifically including a number of optical isolators which function to electrically isolate each of the control input sources from each other. The controller described in the '532 Patent does not provide a means to simultaneously disconnect from the supply all conductors of each dispenser circuit, as required by NEC and NFPA 30A, Section 514-5.

The controller described in the '532 Patent provides for emergency shutdown of the fuel pumps which deliver fuel to the MPD, but does not provide a means for interrupting power to the dispenser itself, as required by Sections (b) and (c) of NEC 514-5 and NFPA 30A.

The controller described in the "532 Patent provides a means of removing external voltage feedback from the dispenser during maintenance and repair, but does not provide a means of disconnecting the power feed to the dispenser. Rather, the device of the '532 Patent addresses voltage isolation only on the downstream side of the fueling dispenser, but does not have means to control power fed upstream to the dispenser, including lighting.

The controller described in the '532 Patent also limits the number of dispensers that can be connected based upon the number of input connections provided and the particular configuration of the matrix switch used. Thus, any expansion plans are required to be considered at the time of initial installation. Misjudgments may result in either too little or too much capacity.

Finally, the controller described in the '532 Patent is designed in such a manner that all the inputs and outputs must be disconnected while the unit is being replaced or repaired.

SUMMARY OF THE INVENTION

Therefore, it is an object of the invention to provide a control circuit for a multi-product dispenser which provides for emergency shutdown of the complete fueling system.

It is another object of the invention to provide a control circuit for a multi-product dispenser which provides product isolation relays to prevent misphasing.

It is another object of the invention to provide a control circuit for a multi-product dispenser which provides for control and shutdown of dispenser canopy lights or other electrical loads contained in the dispenser.

It is another object of the invention to provide a control circuit for a multi-product dispenser which provides for manual shutdown of individual dispensers for service and maintenance.

It is another object of the invention to provide a control circuit for a multi-product dispenser which provides automatic shutdown of individual dispensers in the event of fuel leakage.

It is another object of the invention to provide a control circuit for a multi-product dispenser which includes an electrical interface to submersible pump controls and tank monitoring systems.

It is another object of the invention to provide a control circuit for a multi-product dispenser in which all of the control features of the circuit are contained on a single modular circuit board.

It is another object of the invention to provide a control circuit for a multi-product dispenser wherein the circuit is designed for DIN-rail mounting and includes plug-in network bus connectors whereby multiple control circuits can be easily chained together for controlling multiple MPDs.

It is another object of the invention to provide a control circuit for a multi-product dispenser which is capable of controlling a plurality of submersible pump contactors and thereby eliminate dispenser misphasing and voltage feedback associated with conventionally installed fueling systems.

It is another object of the invention to provide a control circuit for a multi-product dispenser wherein field repairs and modifications can be made by simply replacing a single plug-in modular circuit board.

These and other objects of the present invention are achieved in the preferred embodiments disclosed below by providing a control circuit array for controlling operation of a plurality of multi-product fuel dispensers ("MPDs") in response to control inputs from a control input source. The control circuit array includes an electric power source, switches for fuel grade selection, tank shutdown, emergency shutdown, and MPD lighting and outputs to submersible turbine fuel pumps for supplying fuel to the MPDs. The improvement comprises a modular circuit board for being connected in series to form the control circuit array, wherein each circuit board includes emergency shutoff means for responding to a single emergency shutoff input for shutting off all power to each of the plurality of MPDs and the pumps supplying the MPDs. The control also includes maintenance shutoff means for shutting off all power to a single predetermined one of the plurality of MPDs and the pump supplying the single MPD in preparation for performing maintenance on the single MPD or fuel pump while permitting continued operation of the remaining MPDs and fuel pumps without feedback to the MPD under maintenance from the operating MPDs.

Preferably, switching means are provided for permitting power to the MPD lighting to be interrupted while power continues to be supplied to the MPD dispensers and pump.

BRIEF DESCRIPTION OF THE DRAWINGS

Some of the objects of the invention have been set forth above. Other objects and advantages of the invention will appear as the description proceeds when taken in conjunction with the following drawings, in which.

PRIOR ART

Referring now specifically to the drawings, a conventional prior art fuel dispensing circuit is shown at 10. The circuit 10 controls a typical MPD as is found at convenience stores and self-service islands of service stations. For a convenience store or service station having several MPDs, a separate circuit 10 is required to wired in parallel for each MPD. Ordinarily, each of the components shown in FIG. 1 would be field mounted and wired in separate electrical enclosures, as described above.

Figure 1:
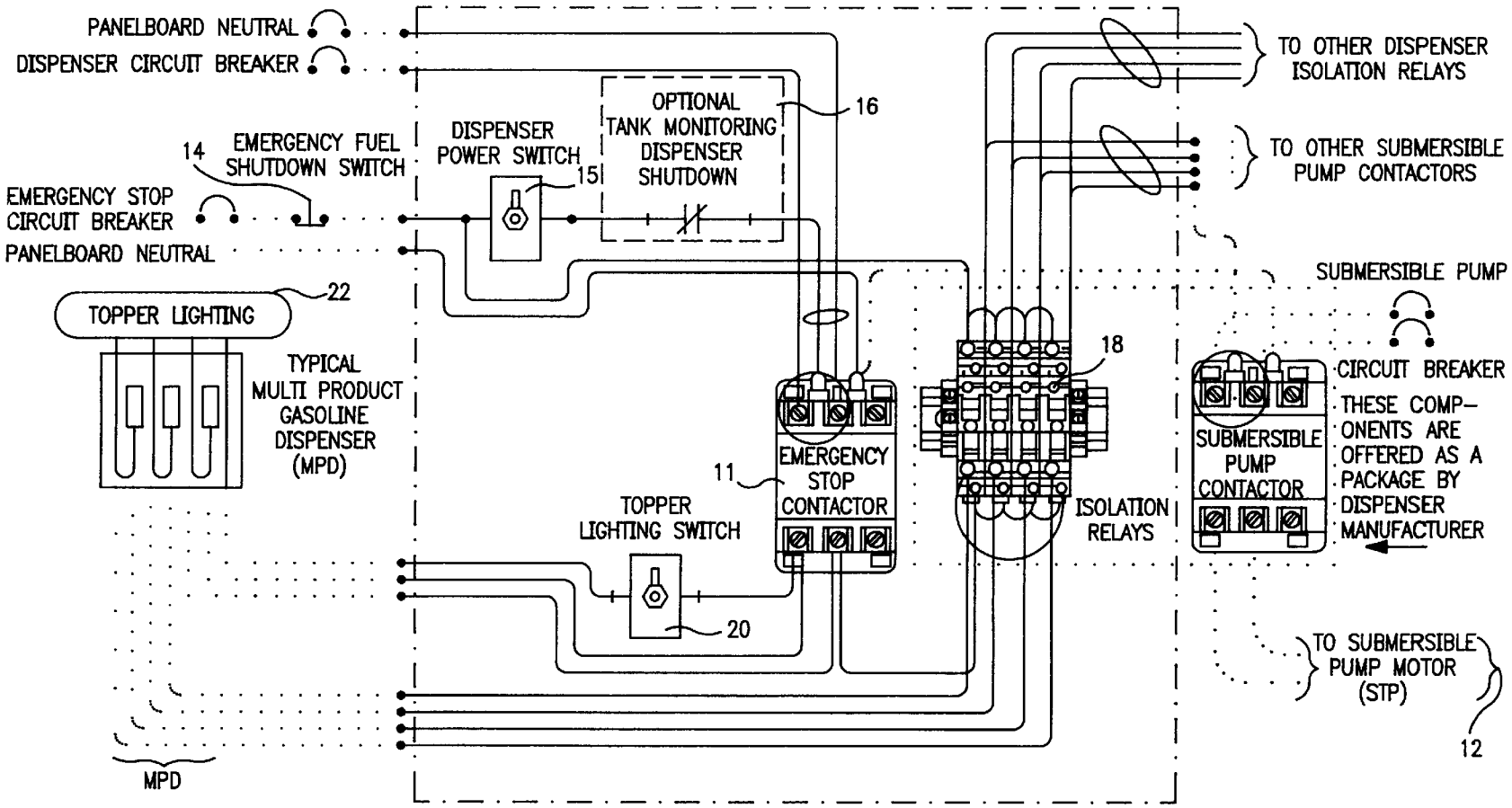
FIG. 1 PRIOR ART
FIG. 1 is a simplified block diagram showing a conventional prior art fuel dispensing control circuit.

As is shown in FIG. 1, activation of the emergency stop switch 14 interrupts power to the dispenser by the action of the emergency stop contactor 11 and also the submersible pump motor 12. Similarly, operation of the dispenser switch 15 disconnects power to the dispenser by opening the emergency stop contactor.

The dispenser switch 15 is also activated when shutting off the dispenser for repairs or maintenance. An optional tank monitor shutdown switch 16 can be wired into the circuit 10 to interface with leak detection sensors (not shown) located in containment pans under each MPD and will similarly interrupt power to the dispenser in the event a leak is detected. A control relay 18 outputs a signal from the MPD to a submersible turbine pump motor 12 corresponding to a grade of fuel selected by a retail customer. A lighting switch 20 permits canopy or "topper" lights 22 to be switched off when desired.

Wire terminations electrically unite the various components of the circuit 10. The large number of terminations increases the possibility of miswiring and poor connections. Field wired conductors connect banks of isolation relays for each MPD and submersible pump motor 12.

DESCRIPTION OF THE PREFERRED EMBODIMENT AND BEST MODE

Modular Control Circuit

Figure 2:
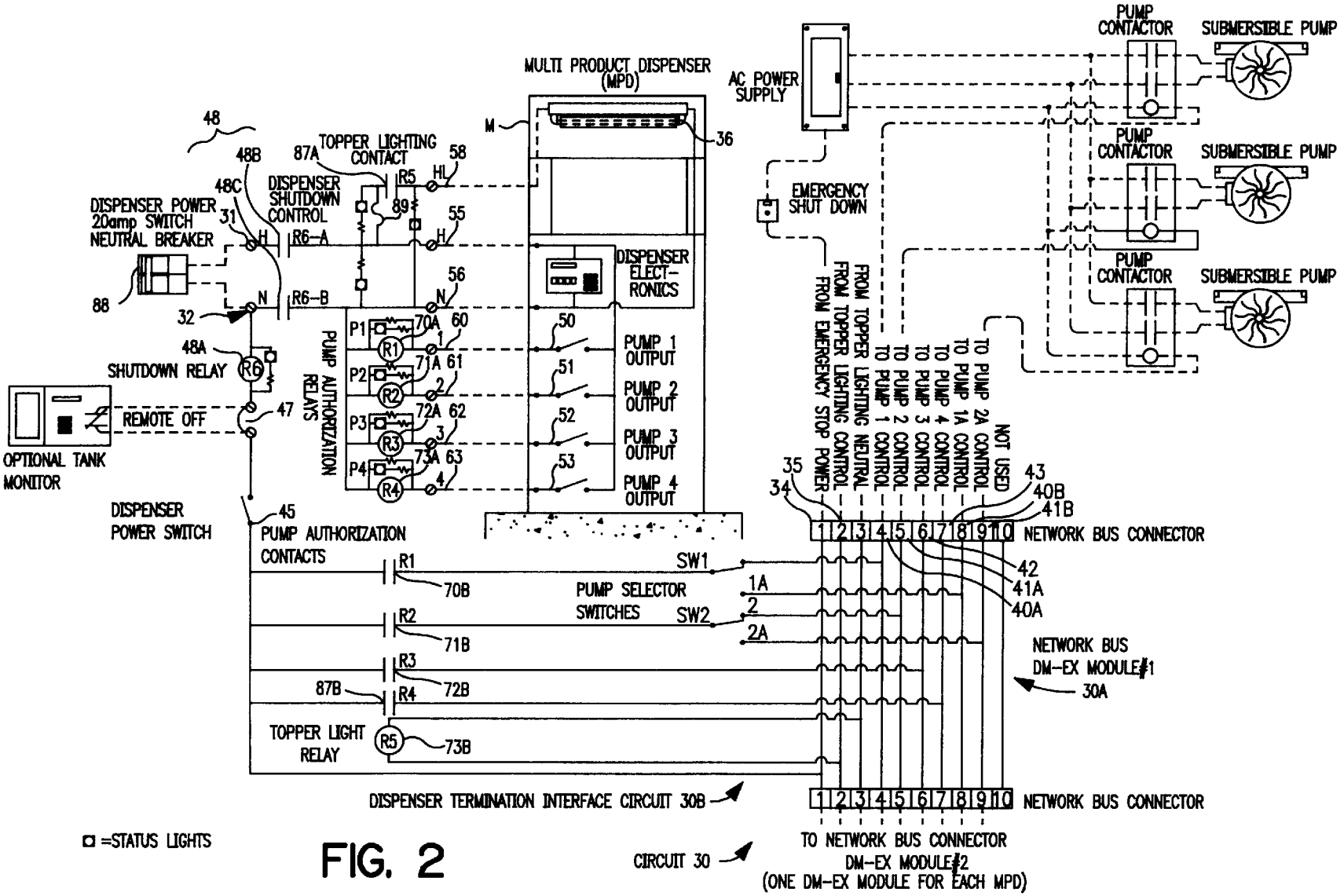
FIG. 2 is a schematic circuit diagram of a control circuit according to an embodiment of the present invention.

A schematic diagram of a modular control circuit 30 according to a preferred embodiment of the invention is shown in FIG. 2. The term "modular" is used to represent that the circuitry is contained on one board, and thereby offers the advantages discussed above. In the vast majority of instances a plurality of modular control circuits 30 will be chained together in series to form a control circuit array to thereby control a like plurality of MPDs—each representing a single location where a consumer can select a fuel type or grade to be dispensed. A single MPD is shown at reference letter "M."

Network Bus Connection Sub-Circuit

Circuit 30 comprises two sub-circuits—the network bus connection circuit 30A and the dispenser terminations interface circuit 30B. Power (120 VAC) is delivered to the "hot" and "neutral" conductors 31 and 32 of the dispenser interface circuit 30B of the MPD circuit 30 from a properly conditioned current source. Network bus connection sub-circuit includes two inputs, an emergency stop input 34, a lighting input 35, and the neutral 32. The emergency stop input 34 is interrupted to circuit 30 when the operator activates an emergency shutoff button in the store or station. This could occur, for example, as the result of a ruptured fuel dispensing hose and is a means of immediately effecting a "global" shutdown of the system.

The lighting input 35 is used to operate the canopy, or "topper" lighting 36 on the MPD "M." This permits the lighting 36 to be switched off during the day without affecting the operation of the remainder of the system. Lighting input 35 may be manually controlled, or operated automatically by a light sensor or timer.

Network bus connection sub-circuit also includes six outputs 40A, 40B, 41A, 41B, 42 and 43. These outputs 40A, 40B, 41A, 41B, 42 and 43 deliver signals to pump controls from the dispenser outputs, as described below. Outputs 40A, 40B and 41A, 41B comprise switches which permit a single MPD signal to control either one of a pair of fuel pumps, for example, to dispense the same grade of fuel from two different MPD positions.

A maintenance switch 45 is used to shutdown a single MPD "M" in a series of connected MPDs. This is in contrast to the situation described above where the emergency stop input 34 is activated, thereby shutting off all power to all of the connected circuits 30.

A jumper 47 is provided for connection to an automatic device such as a tank monitoring system which can disconnect a single MPD "M" from the power source 31 and 32 and any fuel pump circuits which are connected to the MPD outputs 40A, 40B, 41A, 41B, 42 and 43.

The main power relay circuit 48 is preferably a 20 amp, 2 pole switching relay which allows power to flow during normal operation.

Dispenser Interface Termination Sub-Circuit

The dispenser interface termination sub-circuit 30B includes three power output circuits. Current flows out to fuel dispensers 50, 51, 52, and 53 through "hot" and "neutral" conductors 55 and 56. Fuel dispensers 50, 51, 52, and 53 represent switches on the dispenser levers, typically referred to as the "hook signal", since it is transmitted upon removal of the dispenser nozzle and subsequent raising of the "hook" on which the nozzle rested. A signal output from one of the dispenser switches 50, 51, 52 or 53 represents the grade or type of fuel selected by the customer. Output 58 applies power to the topper lighting 36.

Each dispenser 50, 51, 52 and 53 operates through inputs 60, 61, 62 and 63, respectively, which control isolation relay coils 70A, 71A, 72A and 73A, which close the contacts of one of four contactors 70B, 71B, 72B and 73B which permit the signal pass to outputs 40A, 40B, 41A, 41B, 42 and 43 deliver signals back up the network bus connection sub-circuit to the pump controls to thereby begin fuel dispensing.

A relay 87 controls the output 58 to the topper lights. When relay coil 87B is activated from an external source, such as a photocell, timer or manual switch, contactor 87A is closed and the topper lights are turned on. A 5 amp fuse 89 is an overcurrent device which protects the remainder of the circuit from a blown fluorescent ballast or similar current condition which could cause current to travel upstream and trip the main power overcurrent device 88 thereby disconnecting power to both the dispenser switches as well as the lighting circuit.

The emergency stop input 34 and the inputs 60, 61, 62 and 63 are not isolated, as they are electrically connected to the same point (the neutral side of the circuit 32, 56) by board conductors through the relay coils, pilot lights and resistors, as identified on FIG. 2.

The network bus connection sub-circuit 30A and dispenser interface termination sub-circuit 30B are connected by relay contacts 48B and 48C on the hot and neutral sides of the circuit 30.

Operation

The circuit 30 permits automatic, instantaneous compliance with all present and anticipated safety regulations relating to MPDs "M." Circuit 30 responds to an emergency signal, which may be caused by damage to or malfunction of a particular MPD "M." A signal to the emergency stop input 34, manual or automatic, removes power from the main power relay coil 48A by opening hot and neutral relay contacts 48B and 48C. Power is thus disconnected from dispenser terminals 55, 56 and 58 which feed power to the dispenser, in accordance with NFPA 30A and NEC Section 514-5. This also results in power being removed from inputs 60, 61, 62 and 63 and the corresponding relay coils 70A, 71A, 72A and 73A, which opens the relay contacts 70B, 71B, 72B, and 73B such that not power can flow to the fuel pump through outputs 40A, 40B, 41B, 42 and 43, nor can power be fed back from these fuel pumps to dispenser. It should again be emphasized that several circuits 30 are typically chained together, such that the inputs 34 and 35 are connected in series with each through the network bus such that a plurality of MPDs "M" will respond to the input signals simultaneously.

Similarly, operation of the dispenser power switch 45 or the optional remote shutdown device 47 also removes power from the main power relay coil 48A which will result in power being disconnected from the individual dispenser as noted above for maintenance or repair, in accordance with NEC Section 514-6, while allowing the remaining MPDs "M" to operate.

A control circuit for a multi-product dispenser is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A fuel dispensing facility, comprising:

(a) a plurality of multiproduct dispensers ("MPD's") connected to a common fueling source;

(b) a power circuit array including an individual power circuit for each MPD;

(c) MPD switching means interconnecting said power circuit to a fueling control circuit for controlling operation of the fueling source;

(d) a control input source solely and directly derived from the power circuit array for controlling operation of each of the MPD's, said control input source including means for receiving both an automatic and manual input signal indicating that a single MPD should be isolated from the power circuit array and an input signal indicating that all MPD's should be isolated from the power circuit array and a manual input signal indicating that all MPD's should be isolated from the power circuit array; and (e) modular control circuit means connected in series to each of said power circuit array, said modular control circuit means including MPD power circuit isolation means for isolating each individual MPD power circuit from each of the other MPD individual power circuits in the power circuit array.

2. A fuel dispensing facility according to claim 1, and including a network bus having plug-in connection means for electrically interconnecting multiple ones of said fueling control circuits and said control input sources whereby one or more MPD's may be added to the fuel dispensing facility.

3. A fuel dispensing facility according to claim 1, and including manual disconnect means electrically interposed between said power circuit array and said fueling control circuits for permitting manual isolation of any one or more of the MPD's from the power circuit array while permitting continued operation of the remaining MPD's connected to said power circuit array.

4. A fuel dispensing facility, comprising:

(a) a plurality of multiproduct dispensers ("MPD's") connected to a common fueling source;

(b) a power circuit array including an individual power circuit for each MPD;

(c) MPD switching means interconnecting said power circuit to a fueling control circuit for controlling operation of the fueling source;

(d) a control input source solely derived from the power circuit array for controlling operation of each of the MPD's, said control input source including means for receiving both an automatic and manual input signal indicating that a single MPD should be isolated from the power circuit array and manual input signal indicating that all MPD's should be isolated from the power circuit array;

(e) modular control circuit means connected in series to each of said power circuit array, said modular control circuit means including MPD isolation circuit means for isolating a single MPD from the power circuit array in response to a single input signal to said MPD switching means indicating that a single MPD should be isolated from the power circuit array and for isolating all MPD's from the power circuit array in response to a single input signal to said MPD switching means indicating that all MPD's should be isolated from the power circuit array.

* * * * *